US009502800B2

(12) United States Patent
Tran et al.

(10) Patent No.: US 9,502,800 B2
(45) Date of Patent: Nov. 22, 2016

(54) DOUBLE-MATED EDGE FINGER CONNECTOR

(71) Applicant: Intel Corporation, Santa Clara, CA (US)

(72) Inventors: Donald T. Tran, Phoenix, AZ (US); Srikant Nekkanty, Chandler, AZ (US); Rajasekaran Swaminathan, Tempe, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/269,795

(22) Filed: May 5, 2014

(65) Prior Publication Data

US 2015/0318630 A1 Nov. 5, 2015

(51) Int. Cl.

| | |
|---|---|
| ***H01R 12/00*** | (2006.01) |
| ***H01R 12/73*** | (2011.01) |
| ***H01R 12/71*** | (2011.01) |
| ***H01R 12/72*** | (2011.01) |

(52) U.S. Cl.

CPC ..... *H01R 12/732* (2013.01); *H01R 12/714* (2013.01); *H01R 12/721* (2013.01)

(58) Field of Classification Search

CPC ..... H01R 13/631; H01R 13/28
USPC ..... 439/62, 378, 284
See application file for complete search history.

(56) References Cited

U.S. PATENT DOCUMENTS

| | | | | |
|---|---|---|---|---|
| 4,544,223 A * | 10/1985 | Gillett | H05K 7/1402 | 439/260 |
| 6,146,175 A * | 11/2000 | Shibata | H01R 12/714 | 439/284 |
| 6,377,471 B1 * | 4/2002 | Chong, Jr. | G11B 25/043 | 361/679.33 |
| 2015/0079829 A1 * | 3/2015 | Brodsgaard | H01R 24/84 | 439/284 |

* cited by examiner

*Primary Examiner* — Abdullah Riyami
*Assistant Examiner* — Nader Alhawamdeh
(74) *Attorney, Agent, or Firm* — Jordan IP Law, LLC

(57) ABSTRACT

A double-mated edge finger connector that is configured to double the connector density without resorting to a reduction in pitch. A first connector defines a first slot configured to receive and permit horizontal displacement of an edge finger of a second board relative thereto, while a second connector defines a second slot configured to receive and permit horizontal displacement of an edge finger of a first board relative thereto, to thereby establish an electrical connection between the first board and the second board.

7 Claims, 5 Drawing Sheets

DOUBLE-MATED EDGE FINGER CONNECTOR

TECHNICAL FIELD

Embodiments generally relate to edge finger connectors, and more particularly, to a double edge finger connector that increases connector density without reducing pitch.

BACKGROUND

Connector density requirements have increased from one generation to the next. While the demand for densification has increased, connector pitch reduction capability has several limitations. For example, smaller contacts are not generally capable of providing the mechanical force and compliance requirements to meet reliability targets. Smaller contacts are also not generally capable of absorbing variations in manufacturing tolerances. Moreover, signal integrity challenges such as cross-talk increases exponentially as contacts are spatially closer to each other.

BRIEF DESCRIPTION OF THE DRAWINGS

The various advantages of the embodiments will become apparent to one skilled in the art by reading the following specification and appended claims, and by referencing the following drawings, in which:

DESCRIPTION OF EMBODIMENTS

Figure 1A:
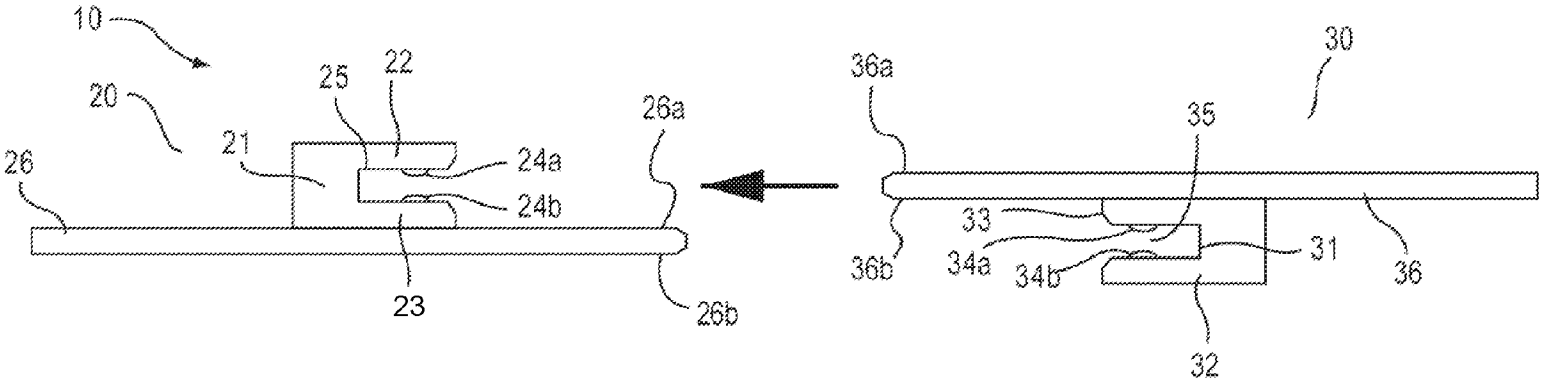
FIGS. 1A and 1B are side views of an example of a double row edge finger connector, in accordance with embodiments.
Figure 1B:
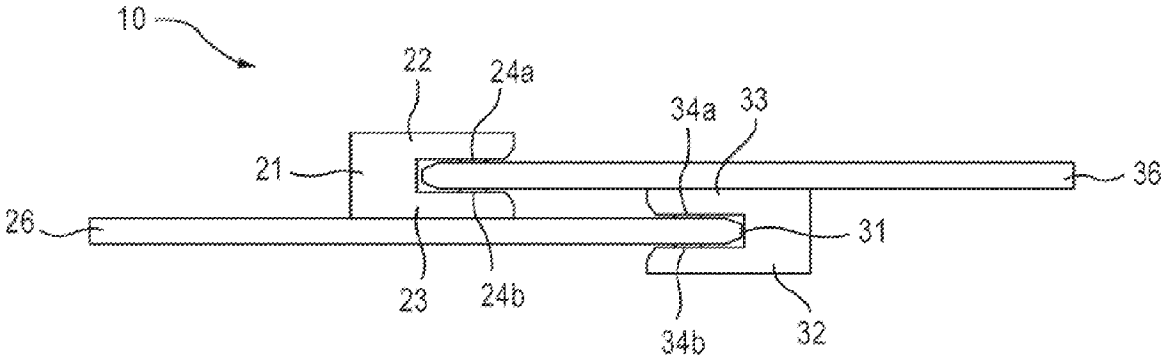

As illustrated in the FIGS. 1A and 1B, embodiments are related to an example of edge finger connectors and associated techniques and configurations. Embodiments provide a solution to at least double the number of contact rows for a horizontal board-to-board (B2B)-type connector.

FIG. 1A illustrates from left to right an apparatus, such as, for example, a package assembly 10 in an unconnected position and which includes a first connector 20 mounted to a first board 26 and a second connector 30 mounted to a second board 36.

The first board 26 has a first edge finger with first electrical pads on upper 26*a* and lower 26*b* sides thereof to route electrical signals to/from the first board 26 to one or more electrical components. For example, the first electrical pads 26*a*, 26*b* may be disposed in a row at the upper side and/or the lower side of the first edge finger. The first electrical pads 26*a*, 26*b* may be aligned in parallel on the first edge finger, or alternatively, in any required spatial arrangement.

The second board 36 has a second edge finger with second electrical pads on upper 36*a* and lower 36*b* sides thereof to route electrical signals to/from the second board 36 to one or more electrical components. For example, the second electrical pads 36*a*, 36*b* may be disposed in a row at the upper side and/or the lower side of the second edge finger. The second electrical pads 36*a*, 36*b* may be aligned in parallel on the second edge finger of the second board 36, or alternatively, in any required spatial arrangement.

FIG. 1B illustrates the package assembly 10 in a connected or mated position which establishes an electrical connection between the first board 26 and the second board 36.

The first connector body 21 includes spaced apart and opposing first extensions or arms 22, 23 extending in parallel to each other to define a first slot 25 configured to receive the second edge finger of the second board 36. In the insertion position, a row of first contacts 24*a* arranged in the upper first arm 22 and a row of first contacts 24*b* arranged in the lower first arm 23 may contact a corresponding one of the second electrical pads 36*a*, 36*b* when the second edge finger is received into the first slot 25. In the inserted position, the second board 36 is at least partially supported on the first connector body 21. In a mated position of the connectors 20, 30, the first connector body 21 is at least partially supported on the second board 36.

The second connector body 31 includes spaced apart and opposing second extensions or arms 32, 33 extending in parallel to each other to define a second slot 35 configured to receive the first edge finger of the first board 26. In the insertion position, a row of second contacts 34*a* arranged in the upper second arm 32 and a row of second contacts 34*b* arranged in the lower second arm 33 may contact a corresponding one of the first electrical pads 26*a*, 26*b* when the first edge finger is received into the second slot 35. In a mated position of the connectors 20, 30, the second board 36 is at least partially supported on the first connector body 21.

By attaching a pair of dual edge finger-type connectors 20, 30, on respective boards 26, 36, the overall number of contacts rows may be doubled from two to four. Accordingly, embodiments serve to increase the overall number of contact rows, particularly for a horizontal B2B-type connector. Moreover, such a design permits horizontal or lateral motion of the second board 36 of the board during a mating/unmating sequence.

Figure 2:
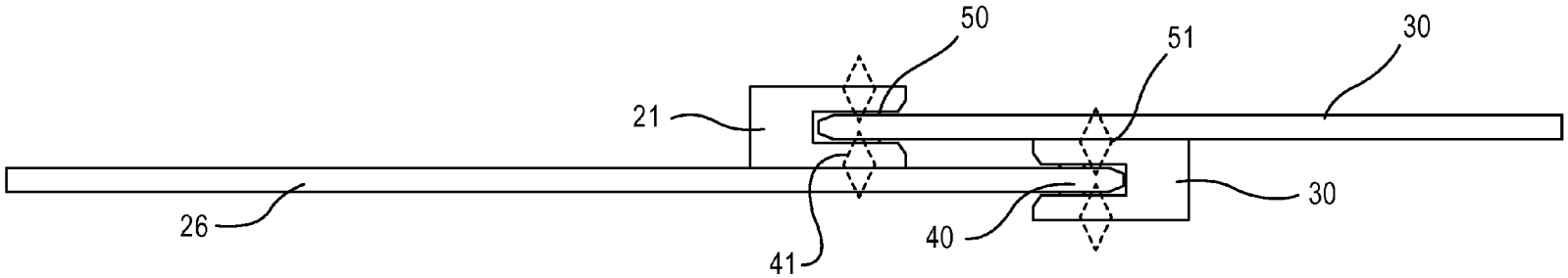
FIG. 2 is a side view of an example of a double row edge finger connector, in accordance with embodiments.

As illustrated in FIG. 2, the design also provides an enhanced mechanical coupling of the boards 26, 36. For instance, while in a mated position, pivotal movement of the first board 26 relative to the second connector 30 is constrained or otherwise restricted at two specific areas. The first area 40 of constrained movement is caused at least partially by the second arms 32, 33 at or adjacent to the second slot 35, while the second area 41 of constrained movement (e.g., upward rotation) is caused by the first connector 20.

Likewise, pivotal movement of the second board 36 relative to the first connector 20 is constrained or otherwise restricted at two specific areas. The first area 50 of constrained movement is caused at least partially by the first arms 22, 23 at or adjacent to the first slot 25, while the second area 51 of constrained movement (e.g., downward rotation) is caused by the second connector 30.

The connector design in accordance with embodiments may be beneficial for certain applications.

Figure 3:
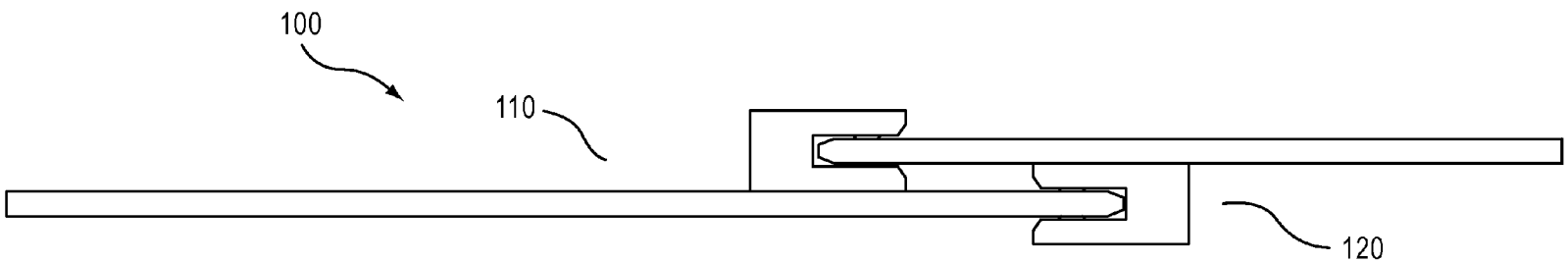
FIG. 3 is a side view of an example of a connector having an application for mobile devices, in accordance with embodiments.

As illustrated in FIG. 3, for example, a system 100 may include a package assembly having a connector to electronically connect a first package 110 comprising a system-on-chip (SoC) module 10 to a second package 120 comprising an I/O module.

Figure 4:
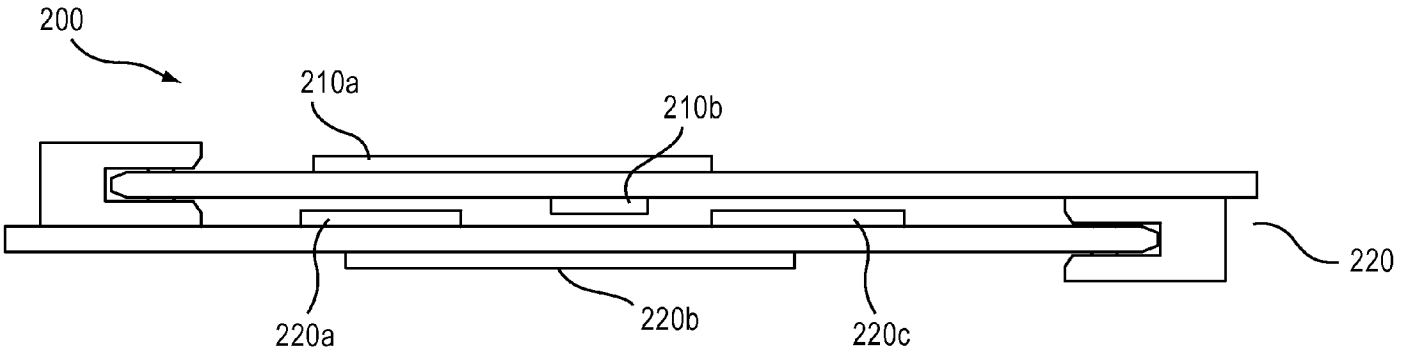
FIG. 4 is a side view of an example of a connector for a circuit board stack, in accordance with embodiments.

As illustrated in FIG. 4, for example, a system 200 may include a package assembly having a connector to electronically connect a first package 210 comprising one or more electronic components 210*a*, 210*b* to a second package 220 comprising one or more electronic components 212*a*, 220*b*, 220C.

Figure 5:
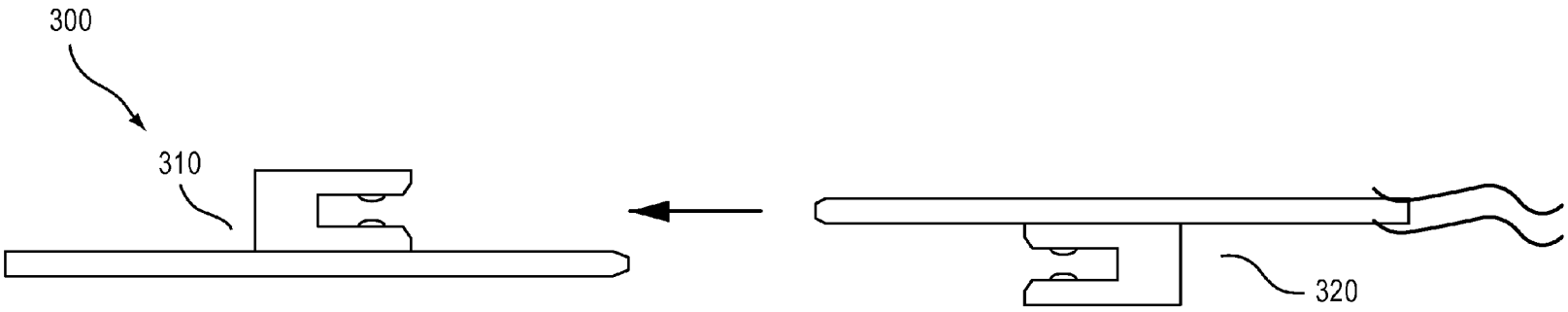
FIG. 5 is a side view of an example of a high density, high speed cable connector, in accordance with embodiments.

As illustrated in FIG. 5, for example, for example, a system 300 may include a package assembly having a high density (HD), high speed (HS) cable connector to electronically connect a motherboard 310 to a paddle card 320.

Figure 6:
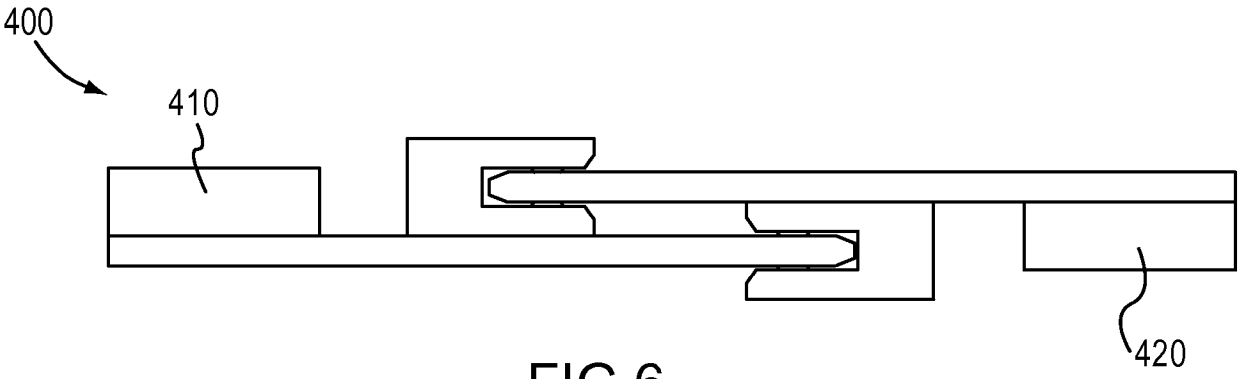
FIG. 6 is a side view of an example of a fabric connector for a NextGen server application with optical integration, in accordance with embodiments.

As illustrated in FIG. 6, for example, a system 400 may include a fabric connector for a NextGen server application with optical integration that includes a CPU 410 electronically connected to an optical trans-receiver 420.

Figure 7:
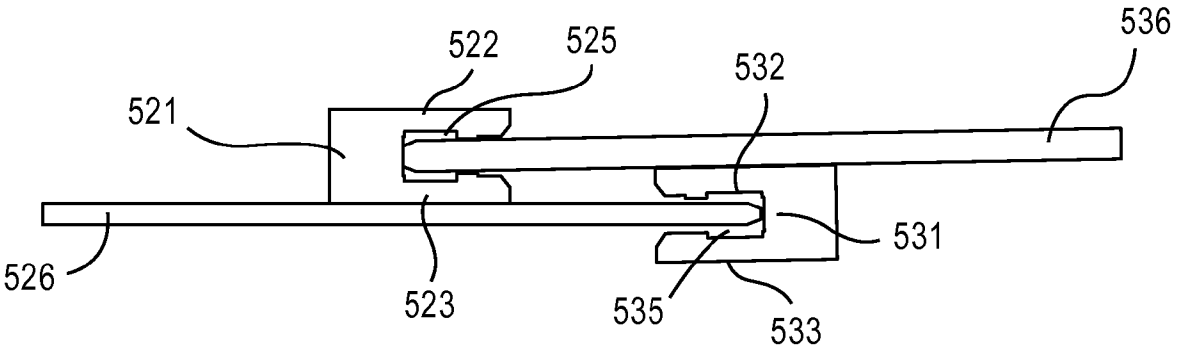
FIG. 7 is a side view of an example of a double row edge finger connector, in accordance with embodiments.

As illustrated in FIG. 7, embodiments may include a package assembly 500 in a connected or mated position which establishes an electrical connection between boards having dimensional mismatches, such as, for example, a first board 526 having a minimal thickness and a second board 536 having a maximum thickness. In particular, the package assembly is configured to absorb material interferences resulting from a double mated assembly in which one board has a first thickness and another board has a second thickness that is different than the first thickness.

For instance, in accordance with embodiments, the first connector body 521 includes spaced apart and opposing first connector extensions or arms 522, 523 extending in parallel to each other to define a first slot 525 configured to receive the second edge finger of the second board 536. The second connector body 531 includes spaced apart and opposing second extensions or arms 532, 533 extending in parallel to each other to define a second slot 535 configured to receive the first edge finger of the first board 526.

A region of an inner surface of each respective one of the first and second connector arms 522, 523, 532, 533 is recessed to permit rotation of a corresponding board 526, 536 when the first board 526 and the second board 536 are electrically and mechanically connected. Accordingly, the slots 525, 535 each comprise a cutout that provides a clearance to permit each respective board 526, 536 to rotate, thereby complying to the mismatch in thicknesses of the boards 526, 536. An amount of rotation may be tolerated by the flexure of the boards 526, 536, and also the contacts. The contacts may comprise a bias mechanism such as, for example, a spring which is configured to absorb some of the dimensional mismatch between boards 526, 536.

Figure 8:
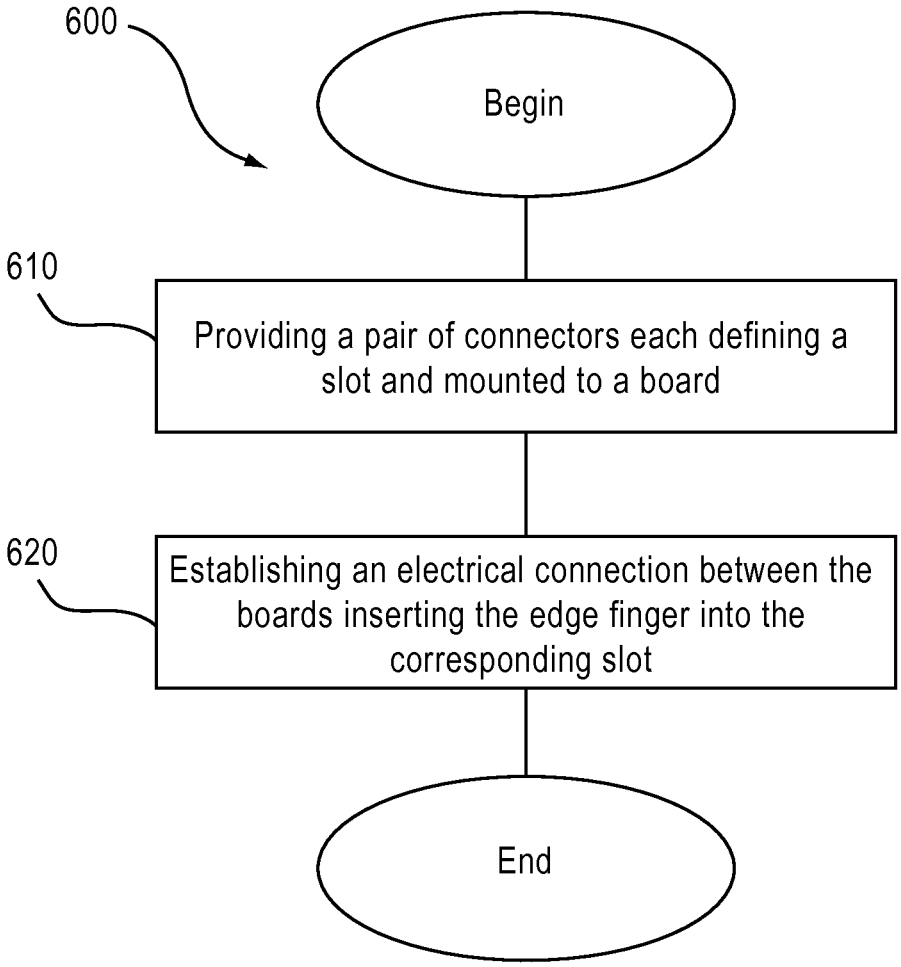
FIG. 8 is a flowchart of an example of a method of manufacturing a computing system, in accordance with embodiments.

As illustrated in FIG. 8, a method 600 of manufacturing a computing system is provided. The method 600 in accordance with embodiments may be implemented as a set of logic and/or firmware instructions stored in a machine- or computer-readable storage medium such as random access memory (RAM), read only memory (ROM), programmable ROM (PROM), flash memory, etc., in configurable logic such as, for example, programmable logic arrays (PLAs), field programmable gate arrays (FPGAs), complex programmable logic devices (CPLDs), in fixed functionality logic hardware using circuit technology such as, for example, application specific integrated circuit (ASIC), complementary metal oxide semiconductor (CMOS) or transistor-transistor logic (TTL) technology, or any combination thereof. For example, computer program code to carry out operations shown in the method 600 may be written in any combination of one or more programming languages, including an object oriented programming language such as Java, Smalltalk, C++ or the like and conventional procedural programming languages, such as the "C" programming language or similar programming languages. In accordance with embodiments, the method 600 may be implemented in the logic 10*a* of the wireless charging device 10, as already discussed herein.

Illustrated processing block 610 may include providing a pair of connectors each defining a slot and mounted to a respective board having an edge finger with electrical pads on upper and lower sides thereof to route electrical signals to or from the board.

Illustrated processing block 620 may include establishing an electrical connection between the boards by inserting the edge finger into the corresponding slot such that the slots are permit horizontal displacement of the corresponding edge finger relative thereto.

Additional Notes and Examples:

Example One may include an apparatus to connect edge fingers, comprising a pair of connecting means each defining a slot and mounted to a respective board having an edge finger with electrical pads on upper and lower sides thereof to route electrical signals to or from the board, wherein each slot is configured to receive and permit horizontal displacement of a corresponding edge finger relative thereto, to thereby establish an electrical connection between the boards.

Example Two may include the apparatus of Example One, the connecting means each comprise a first connector and a second connector, and the boards comprises a first board upon which the first connector is mounted and a second board upon which the second connector is mounted.

Example Three may include the apparatus of Example Two, wherein the first connector comprises a first connector body having first contacts arranged in upper and lower opposing rows in the first slot and which contact the second electrical pads when the second edge finger is received into the first slot.

Example Four may include the apparatus of any one of Examples Two and Three, wherein the second connector comprises a second connector body having second contacts arranged in upper and lower opposing rows in the second slot and which contact the first electrical pads when the first edge finger is received into the second slot.

Example Five may include the apparatus of Example Two, wherein the first connector comprises a first connector body having a pair of first connector body extensions extending spaced apart and in parallel to define the first slot.

Example Six may include the apparatus of Example Five, wherein a region of an inner surface of each respective one of the first connector body extensions is recessed to permit rotation of the second board when the first board and the second board are electrically and mechanically connected.

Example Seven may include the apparatus of any one of Examples Two and Five, wherein the second connector comprises a second connector body having a pair of second connector body extensions extending spaced apart and in parallel to define the second slot.

Example Eight may include the apparatus of Example Seven, wherein a region of an inner surface of each respective one of the second connector body extensions is recessed to permit rotation of the first board when the first board and the second board are electrically and mechanically connected.

Example Nine may include a system that utilizes edge connectors, comprising a package assembly including a pair of packages having connecting means defining a slot and mounted to a respective board having an edge finger with electrical pads on upper and lower sides thereof to route electrical signals to or from the board, wherein each slot is configured to receive and permit horizontal displacement of a corresponding edge finger relative thereto, to thereby establish an electrical connection between the boards.

Example Ten may include the system of Example Nine, wherein the connectors comprise a first connector and a second connector; and the boards comprises a first board upon which the first connector is mounted and a second board upon which the second connector is mounted.

Example Eleven may include the system of Example Ten, wherein the first connector comprises a first connector body having first contacts arranged in upper and lower opposing rows in the first slot and which contact the second electrical pads when the second edge finger is received into the first slot.

Example Twelve may include the system of Example Ten, wherein the second connector comprises a second connector body having second contacts arranged in upper and lower opposing rows in the second slot and which contact the first electrical pads when the first edge finger is received into the second slot.

Example Thirteen may include the system of Example Ten, wherein the first connector comprises a first connector body having a pair of first connector body extensions extending spaced apart and in parallel to define the first slot.

Example Fourteen may include the system of Example Thirteen, wherein a region of an inner surface of each respective one of the first connector body extensions is recessed to permit rotation of the second board when the first board and the second board are electrically and mechanically connected.

Example Fifteen may include the system of Example Ten, wherein the second connector comprises a second connector body having a pair of second connector body extensions extending spaced apart and in parallel to define the second slot.

Example Sixteen may include the system of Example Fifteen, wherein a region of an inner surface of each respective one of the second connector body extensions is recessed to permit rotation of the first board when the first board and the second board are electrically and mechanically connected.

Example Seventeen may include a method, comprising providing a pair of connectors each defining a slot and mounted to a respective board having an edge finger with electrical pads on upper and lower sides thereof to route electrical signals to or from the board and establishing an electrical connection between the boards by inserting the edge finger into the corresponding slot such that the slots are permit horizontal displacement of the corresponding edge finger relative thereto.

Example Eighteen may include the method of Example Seventeen, wherein the connectors comprise a first connector and a second connector, and the boards comprise a first board upon which the first connector is mounted and a second board upon which the second connector is mounted.

Example Nineteen may include the method of Example Eighteen, wherein the first connector comprises a first connector body having first contacts arranged in upper and lower opposing rows in the first slot and which contact the second electrical pads when the second edge finger is received into the first slot.

Example Twenty may include the method of Example Eighteen, wherein the second connector comprises a second connector body having second contacts arranged in upper and lower opposing rows in the second slot and which contact the first electrical pads when the first edge finger is received into the second slot.

Example Twenty-One may include the method of Eighteen, wherein the first connector comprises a first connector body having a pair of first connector body extensions extending spaced apart and in parallel to define the first slot.

Example Twenty-Two may include the method of Example Twenty-One, wherein a region of an inner surface of each respective one of the first connector body extensions is recessed to permit rotation of the second board when the first board and the second board are electrically and mechanically connected.

Example Twenty-Three may include the method of Example Eighteen, wherein the second connector comprises a second connector body having a pair of second connector body extensions extending spaced apart and in parallel to define the second slot.

Example Twenty-Four may include the method of Example Twenty-Three, wherein a region of an inner surface of each respective one of the second connector body extensions is recessed to permit rotation of the first board when the first board and the second board are electrically and mechanically connected.

Example Twenty-Five may include an apparatus, comprising a first printed circuit board (PCB) coupled to a first dual row edge finger type connector, the first dual row edge finger type connector to be electrically coupled to a second PCB, the first PCB having a first row of contacts disposed on an upper side of first PCB, and a second row of contacts disposed on a bottom side of the first PCB, wherein the first and second row of contacts are to be electrically coupled to a second dual row edge finger type connector to be disposed on the second PCB.

Embodiments are applicable for use with all types of computing devices, such as, for example, a smart phone, mobile Internet device (MID), smart tablet, convertible tablet, notebook computer, a server, a laptop, a netbook, a notebook, an ULTRABOOK, a smartphone, a tablet, a personal digital assistant (PDA), an ultra mobile PC, a mobile phone, a desktop computer, a printer, a scanner, a monitor, a set-top box, an entertainment control unit, a digital camera, a portable music player, a digital video recorder, and any other electronic device that processes data.

Embodiments may include any suitable combination of the above-described embodiments. Furthermore, some embodiments may include one or more non-transitory computer-readable media having instructions, stored thereon, that when executed result in actions of any of the above-described embodiments. Moreover, some embodiments may include apparatuses or systems having any suitable means for carrying out the various operations of the above-described embodiments.

The term "coupled" or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

We claim:

1. An apparatus, comprising:

a package assembly including:

a first connector including a first printed circuit board (PCB) having a first edge finger with first electrical pads on upper and lower sides thereof to route electrical signals to or from the first PCB, and a first connector body mounted upon the first PCB, the first connector body having spaced apart first arms extending in parallel to each other to define a first slot, the first arms bearing first contacts arranged in the first slot; and a second connector including a second PCB having a second edge finger with second electrical pads on upper and lower sides thereof to route electrical signals to or from the second PCB, and a second connector body mounted upon the second PCB, the second connector body having spaced apart second arms extending in parallel to each other to define a second slot, the second arms bearing second contacts arranged in the slot, wherein in a mated position of the first connector and the second connector to thereby establish an electrical connection between the first PCB and the second PCB, the first edge finger is received in the second slot, the second edge finger is received in the first slot, the first electrical pads contact the second contacts and the second electrical pads contact the first contacts.

2. The apparatus of claim 1, wherein in the mated position of the first connector and the second connector, the first slot permits horizontal displacement of the second edge finger relative thereto.

3. The apparatus of claim 1, wherein in the mated position of the first connector and the second connector, the second slot permits horizontal displacement of the first edge finger relative thereto.

4. The apparatus of claim 1, wherein a region of an inner surface of the first arm is recessed to permit rotation of the second PCB when the second edge finger is received in the first slot.

5. The apparatus of claim 1, wherein a region of an inner surface of the second arm is recessed to permit rotation of the first PCB when the first edge finger is received in the second slot.

6. The apparatus of claim 1, wherein the first slot comprises a first cutout to provide a clearance to permit rotation of the second PCB board received therein.

7. The apparatus of claim 1, wherein the second slot comprises a second cutout to provide a clearance to permit rotation of the first PCB board received therein.

* * * * *